US010092093B2

(12) United States Patent
Campbell, Jr. et al.

(10) Patent No.: US 10,092,093 B2
(45) Date of Patent: Oct. 9, 2018

(54) BAG WITH INTEGRAL LEGS

(71) Applicants: Eddie James Campbell, Jr., Wake Forest, NC (US); Lydia Elaine Boyd Campbell, Wake Forest, NC (US)

(72) Inventors: Eddie James Campbell, Jr., Wake Forest, NC (US); Lydia Elaine Boyd Campbell, Wake Forest, NC (US)

( * ) Notice: Subject to any disclaimer, the term of this patent is extended or adjusted under 35 U.S.C. 154(b) by 0 days.

(21) Appl. No.: 15/477,456

(22) Filed: Apr. 3, 2017

(65) Prior Publication Data

US 2017/0280868 A1 Oct. 5, 2017

Related U.S. Application Data

(60) Provisional application No. 62/316,671, filed on Apr. 1, 2016.

(51) Int. Cl.

| | |
|---|---|
| ***A45C 9/00*** | (2006.01) |
| ***A47B 23/06*** | (2006.01) |
| ***A47B 3/10*** | (2006.01) |
| ***A47B 23/00*** | (2006.01) |
| ***A47B 9/20*** | (2006.01) |
| ***A47B 3/08*** | (2006.01) |
| ***A47B 1/10*** | (2006.01) |
| ***A45C 13/10*** | (2006.01) |
| ***A45C 13/26*** | (2006.01) |
| ***A45C 13/02*** | (2006.01) |

(52) U.S. Cl.

CPC ..... *A47B 23/06* (2013.01); *A45C 13/02* (2013.01); *A45C 13/103* (2013.01); *A45C 13/26* (2013.01); *A47B 1/10* (2013.01); *A47B 3/0818* (2013.01); *A47B 3/10* (2013.01); *A47B 9/20* (2013.01); *A47B 23/001* (2013.01)

(58) Field of Classification Search

CPC ..... A45C 9/00; A45C 13/103; A45C 2200/15; A45C 13/26; A47B 23/06

USPC ..... 190/18 R

See application file for complete search history.

(56) References Cited

U.S. PATENT DOCUMENTS

| | | | | |
|---|---|---|---|---|
| 873,855 | A * | 12/1907 | Goldin | A45C 9/00 108/38 |
| 2,648,366 | A | 8/1953 | Lona et al. | |
| 4,856,627 | A * | 8/1989 | Polatov | A45C 9/00 190/11 |
| 4,986,395 | A * | 1/1991 | Lewis | A45C 9/00 190/1 |

(Continued)

*Primary Examiner* — Sue A Weaver

(74) *Attorney, Agent, or Firm* — Global Intellectual Property Agency, LLC; Daniel Boudwin

(57) ABSTRACT

A bag with integral legs. The bag includes a base with sidewalls forming a main compartment with an interior volume. A pair of legs is attached to a lower side of the base and configured to pivot between a stowed position and an extended position. In the extended position, the bag is supported off of a ground surface at a desired height. Additionally, the bag includes a tray configured to extend outwardly from the bag, providing a convenient work surface for a user. The bag may further include a lower pocket adapted to fully enclose the pair of legs therein when the pair of legs is in the stowed position. Some embodiments include a locking hinge to lock each of the pair of legs either in a stowed or in an extended position, offering additional stability to the bag when in an elevated position.

17 Claims, 7 Drawing Sheets

(56) References Cited

U.S. PATENT DOCUMENTS

| | | | | |
|---|---|---|---|---|
| 6,036,011 | A * | 3/2000 | DeCurtis | A45C 15/00 190/11 |
| 6,068,355 | A * | 5/2000 | Thorp | A45C 9/00 108/177 |
| 7,870,937 | B1 | 1/2011 | Arnao | |
| 7,987,955 | B2 * | 8/2011 | Puchalski | A45C 5/14 190/10 |
| 8,181,760 | B2 * | 5/2012 | Trieu | A45C 11/38 190/1 |
| 8,540,063 | B2 * | 9/2013 | LaTowsky | A45C 5/14 190/18 A |
| 8,616,354 | B2 * | 12/2013 | Azirian | A47B 3/10 190/1 |
| 9,027,721 | B1 | 5/2015 | Osborne | |
| 2002/0063072 | A1 * | 5/2002 | Pham | A45C 5/14 206/320 |
| 2004/0226791 | A1 | 11/2004 | Levy | |
| 2006/0037873 | A1 * | 2/2006 | Elgart | A45C 9/00 206/223 |
| 2007/0278058 | A1 | 12/2007 | Angel | |
| 2014/0216873 | A1 * | 8/2014 | Torres Montes | A45C 9/00 190/11 |

* cited by examiner

BAG WITH INTEGRAL LEGS

CROSS REFERENCE TO RELATED APPLICATIONS

This application claims the benefit of U.S. Provisional Application No. 62/316,671 filed on Apr. 1, 2016. The above identified patent application is herein incorporated by reference in its entirety to provide continuity of disclosure.

BACKGROUND OF THE INVENTION

The present invention relates to a bag. More specifically, the present invention relates to bags having integral legs attached thereto, configured to allow the bag to rest at an elevated position without the need for a separate resting surface.

Many individuals carry work tools, supplies and other items in easily transportable bags. For example, nurses or other medical professionals may wish to have certain supplies readily available when they are visiting various patients. However, resting a medical bag down on any available surface may not provide a convenient position for easily accessing the contents stored therein. Some surfaces may be too low or too distant from the patient to be conveniently used. Additionally, some supplies and tools require an open planar surface to properly prepare them for use, which may not be readily available within the room that a patient is located in.

Additionally, bacteria and germs may be present, potentially at elevated numbers within the living space of ill patients. In order to minimize the probability of spreading disease from one patient to another, a separation barrier is often placed between a bag and any surface within the patient's living space. However, setting up such a barrier can be cumbersome and inconvenient to do, especially if the medical professional visits multiple patients per day. Accordingly, a bag designed to be supported at a desirable working height with integral support legs, keeping the bottom of the bag separate from any unwanted germs or bacteria is desired.

SUMMARY OF THE INVENTION

In view of the foregoing disadvantages inherent in the known types of bags now present in the prior art, the present invention provides a bag wherein the same can be utilized for providing convenience for the user when wishing to have the bag rest at an elevated position without the need for a separate support device. The present system comprises a bag with integral legs having a base and sidewalls forming a main compartment with an interior volume. A pair of legs is pivotally secured to opposing ends of a lower side of the base, where the legs are configured to pivot between a stowed position and an extended position. When the legs are in an extended position, they are configured to support the bag off of a ground surface. In some embodiments, the legs comprise multiple telescopic sections to allow a user to adjust the working height of the bag. Additionally, the bag further comprises a tray secured to a sidewall, where the tray is configured to extend outwardly from the bag and remain in a stable position, providing a convenient work surface for a user at an elevated height. The bag may further contain a lower pocket below the base, adapted to fully enclose the pair of legs therein when the pair of legs is in the stowed position.

In some embodiments of the bag with integral legs, a locking hinge is provided and secured within the lower pocket. The locking hinge is configured to lock each of the pair of legs either in a stowed or in an extended position to ensure that legs are not shifted inadvertently during use, offering additional stability to the bag when in an elevated position.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
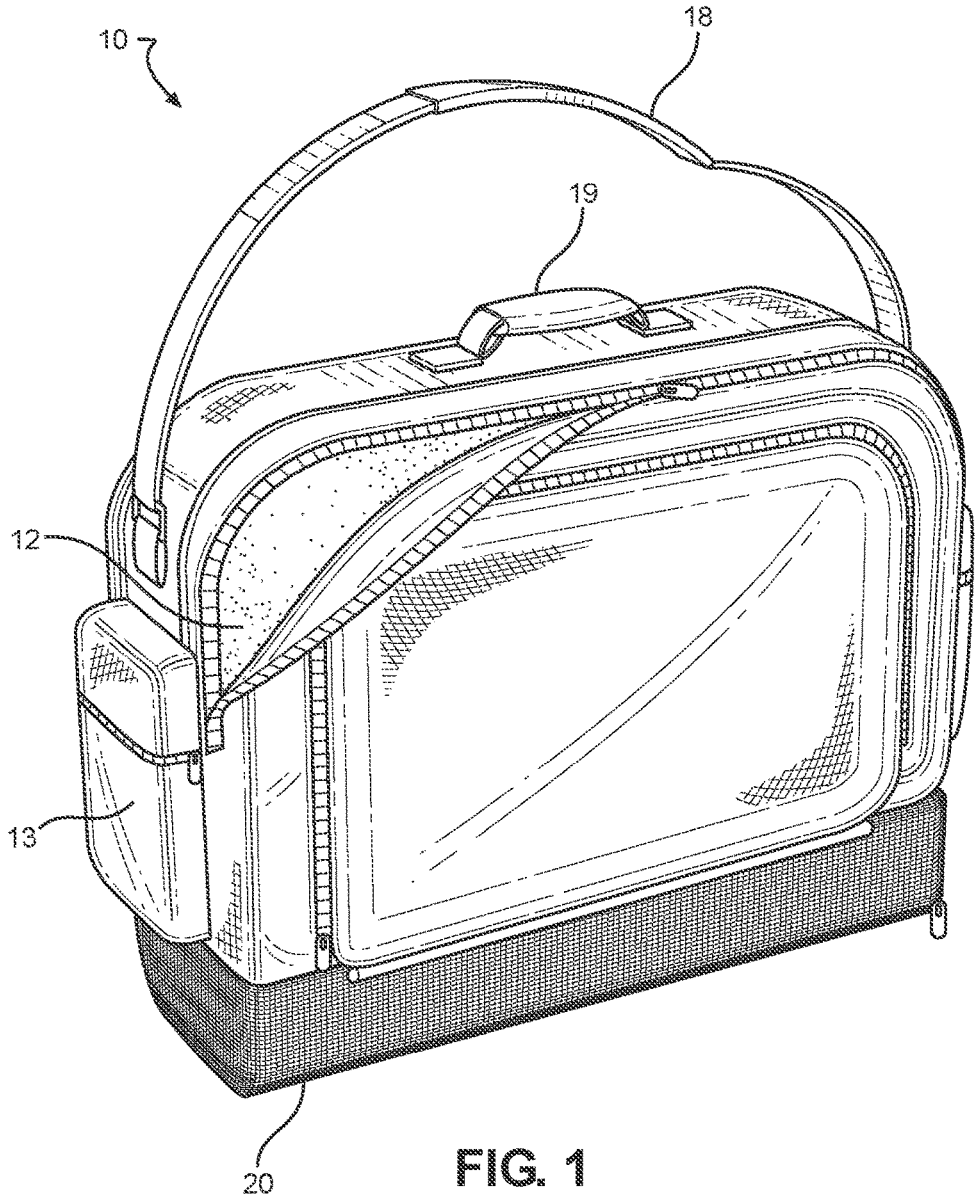
FIG. 1 shows a perspective view of one embodiment of the bag with integral legs.

Reference is made herein to the attached drawings. Like reference numerals are used throughout the drawings to depict like or similar elements of the bag. The figures are intended for representative purposes only and should not be considered to be limiting in any respect.

Figure 2:
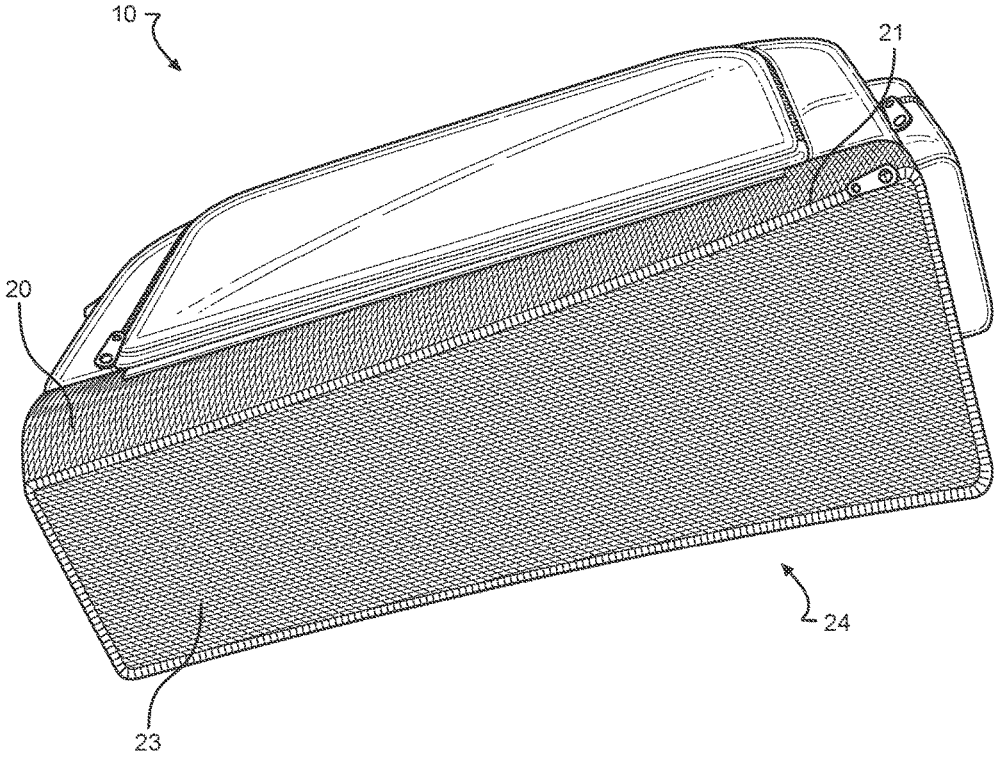
FIG. 2 shows a bottom view of the lower pocket of the bag with integral legs.

Referring now to FIGS. 1 and 2, there is shown a perspective view of one embodiment of the bag with integral legs, and a bottom view of the lower pocket of the bag with integral legs, respectively. The bag with integral legs comprises a bag 10 having a base 20 and sidewalls forming a main compartment with an interior volume 12. The main compartment includes an opening adapted to provide easy access to the interior volume 12 of the main compartment, wherein the opening is securably closable via a fastener. Any variation of fastener may be used, such as a zipper or any similar fastening device. Secondary compartments 13 may be provided on the interior or exterior of the bag 10 to provide for additional storage sections.

A lower pocket 24 is disposed beneath the main compartment on the base 20 and is configured to enclose a pair of legs therein. In some embodiments, the lower pocket 24 further includes a cover 23 that is securably closeable via a fastener 21, such that when the pair of legs is stowed within the lower pocket 24, the cover 23 can fully conceal and protect the pair of legs.

One or more carrying handles are secured to the bag 10 in order to allow for a convenient method of transportation. In some embodiments, a small handle 19 is secured to an upper portion of the bag 10, while in further embodiments a shoulder strap 18 may be secured to two opposing sides of the bag 10.

In some embodiments of the bag with integral legs 10, there is a compartment that is configured to be securely closed and locked in order to offer a place to safely store sensitive patient information, such as paperwork or test results. For example, a pocket may be disposed within the interior volume 12 or along an exterior sidewall of the bag 10 and further comprise a locking mechanism, such as a combination lock or a latch adapted to have a padlock attached thereto. Sensitive patient information may be placed therein and locked to prevent unauthorized access. Thus, a user may easily carry such information along with their medical tools and supplies within the bag with integral legs 10 without compromising the security of sensitive paperwork.

Figure 3A:
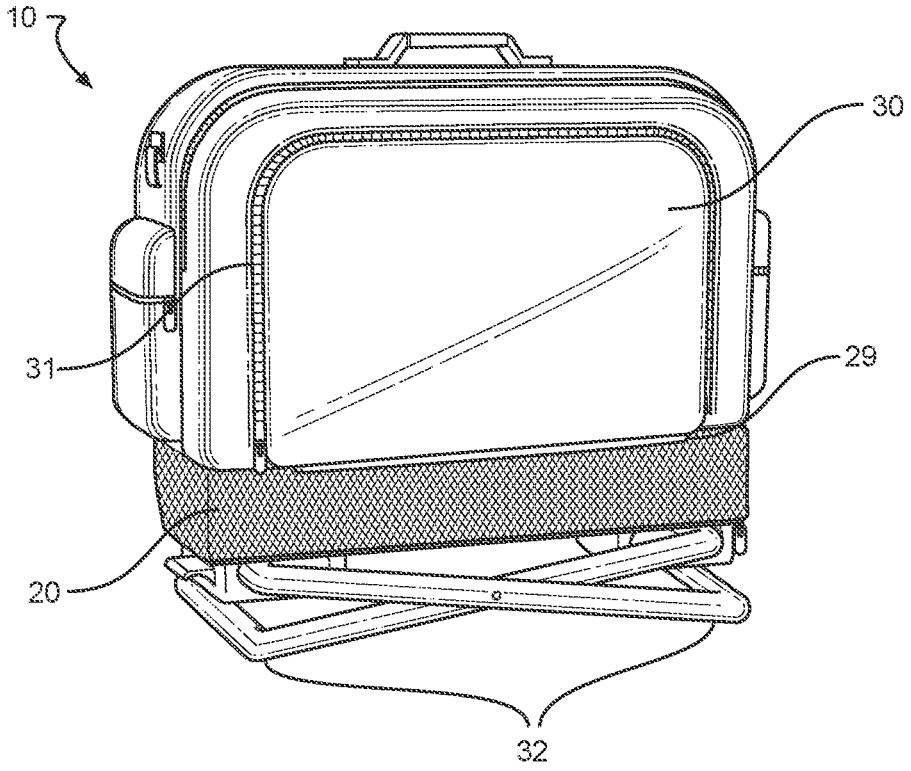
FIG. 3A shows a perspective view of the bag with integral legs with the legs in a crisscross configuration and the tray in a stowed position.
Figure 3B:
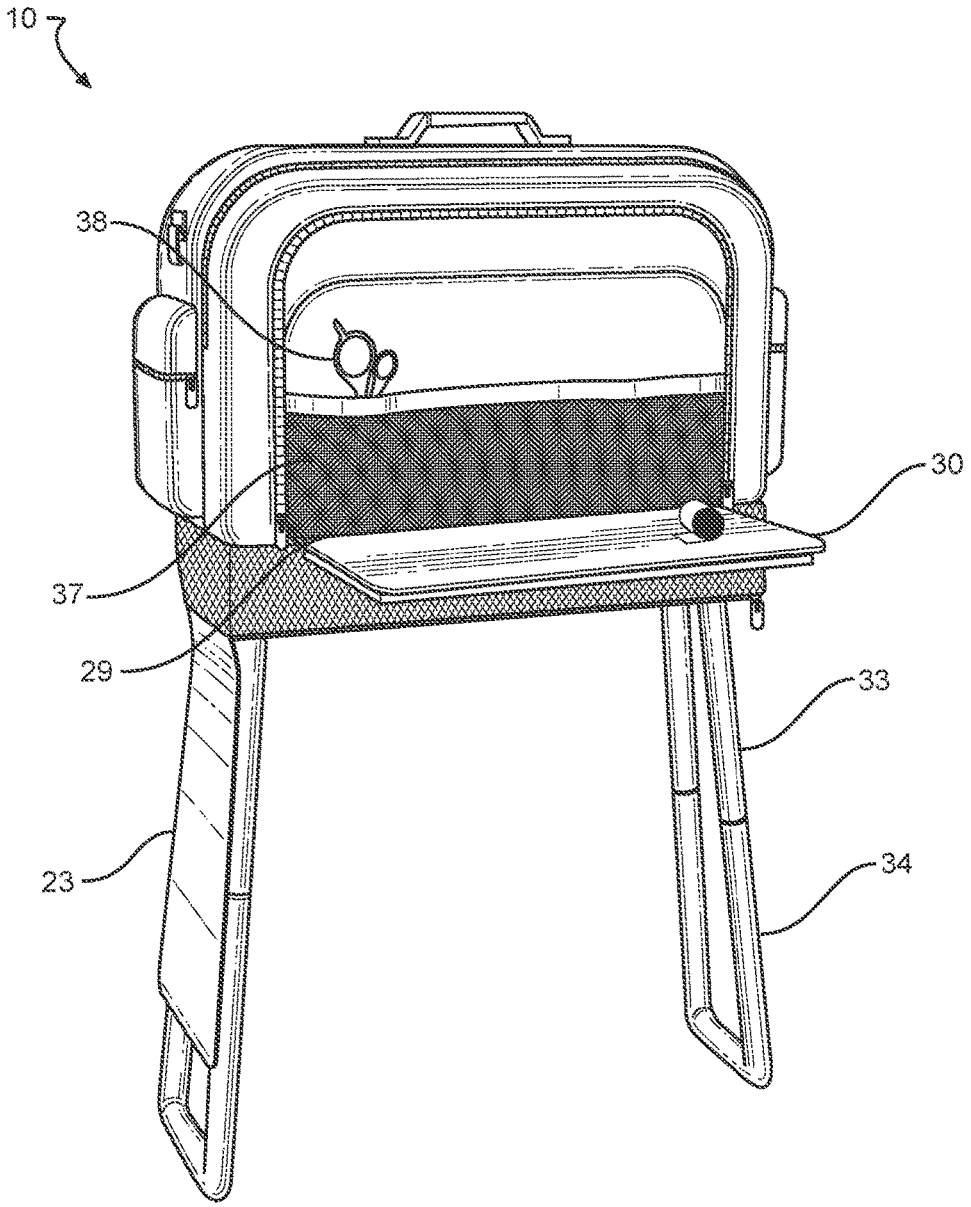
FIG. 3B shows a perspective view of the bag with integral legs with the legs in an extended position and the tray in an extended position.

Referring now to FIGS. 3A and 3B, there is shown a perspective view of the bag with integral legs with the legs in a crisscross configuration and the tray in a stowed position, and a perspective view of the bag with integral legs with the legs in an extended position and the tray in an extended position, respectively. Each of the pair of legs 32 is pivotally secured to opposing ends of a lower side of the base 20, wherein the pair of legs 32 is configured to pivot between a stowed position and an extended position.

In one embodiment of the bag with integral legs, each of the pair of legs 32 can pivot away from the base 20 of the bag 10 into an extended position, as shown in FIG. 3B, where they are configured to support the bag 10 in an elevated position off of a ground surface. For example, a medical professional using the bag for medical supplies may enter a patient's room with the bag 10 and use the pair of legs 32 to place the bag 10 at a comfortable working height without requiring a table or similar surface upon which to rest the bag 10. This allows for a versatile and convenient setup in a broad range of scenarios. In some embodiments, the pair of legs 32 are height adjustable. For example, each of the pair of legs 32 may comprise multiple telescopic sections 33, 34 that can be locked relative to one another at various height levels.

A tray 30 is further secured to the bag 10, wherein the tray 30 is configured to extend outwardly from the bag 10 and remain in a stable position, allowing a user, such as the aforementioned medical professional, to have a portable work surface integral to the bag 10. In some embodiments, the tray 30 is configured to be a front panel of a secondary side pocket of the bag 10 and may be secured to the sidewall of the bag 10 via a fastener 31. The tray 30 may be additionally secured along a bottom edge 29 to the sidewall of the bag 10, such as via a living hinge.

Figure 4:
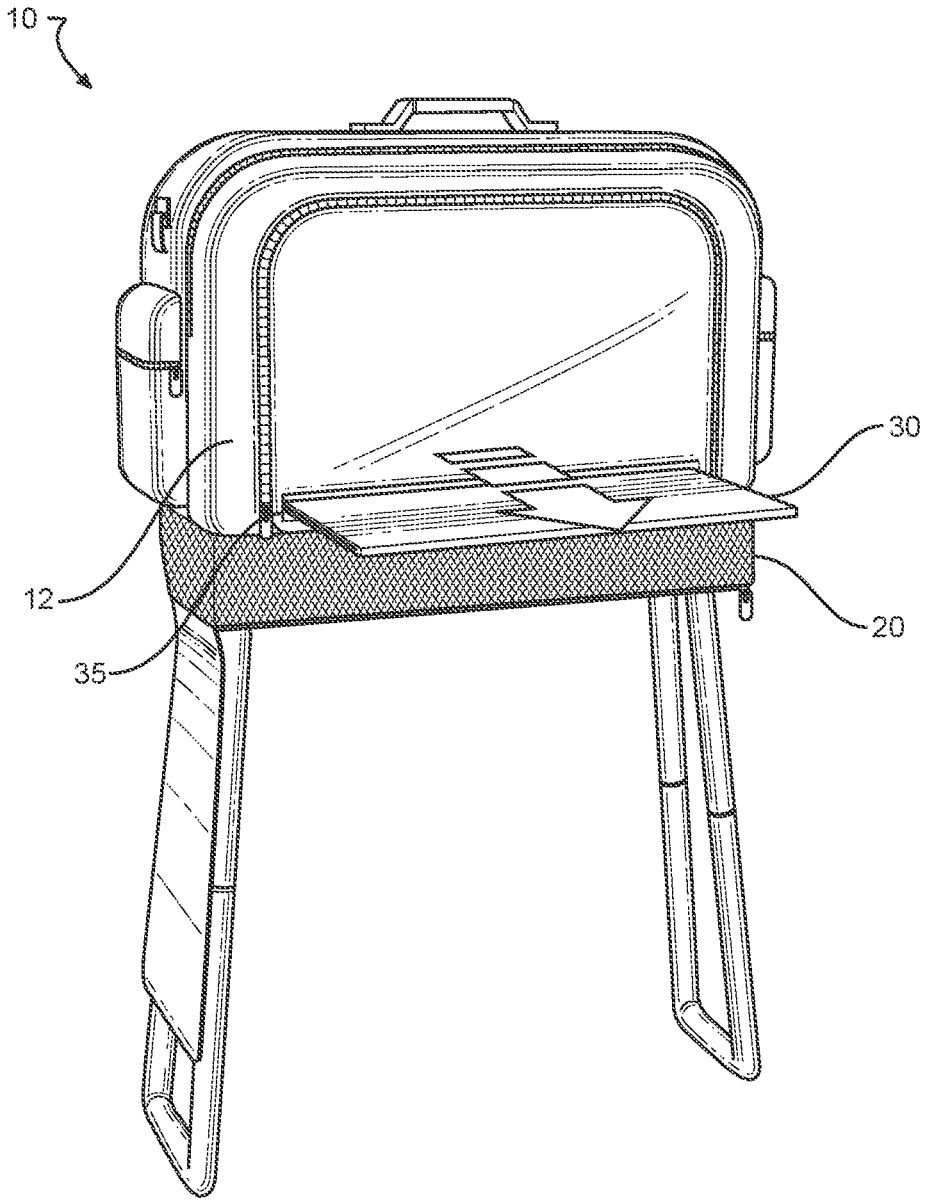
FIG. 4 shows a perspective view of an alternative embodiment of the bag with integral legs with the tray extending from a slot disposed along the base of the bag.

Referring now to FIG. 4, there is shown a perspective view of an alternative embodiment of the bag with integral legs with the tray extending from a slot disposed along the base of the bag. In this embodiment, the base 20 of the bag 10 further comprises a slot 35 adapted to slidably receive the tray 30. In use, the tray 30 can be removed from the slot 35 to extend exterior to the bag 10. A rigid portion of the tray 30 remains within the slot 35 beneath the base 20 of the bag 10 to provide sufficient support for items placed on top of the tray 30.

Referring now to FIGS. 5A, 5B, 6A and 6B, there are shown cross sectional views of the locking bracket of an alternative embodiment of the bag with integral legs with a leg in a stowed position and an extended position, respectively. In some embodiments of the bag with integral legs, a locking hinge 49 is provided and securing within the lower pocket, beneath the base. The locking hinge 49 comprises a bracket 50 having a slot 51, wherein the top of one of the pair of the legs 32 is inserted within the slot 51. In this embodiment, the legs 32 are configured in a crisscross arrangement when in an extended position.

Figure 5A:
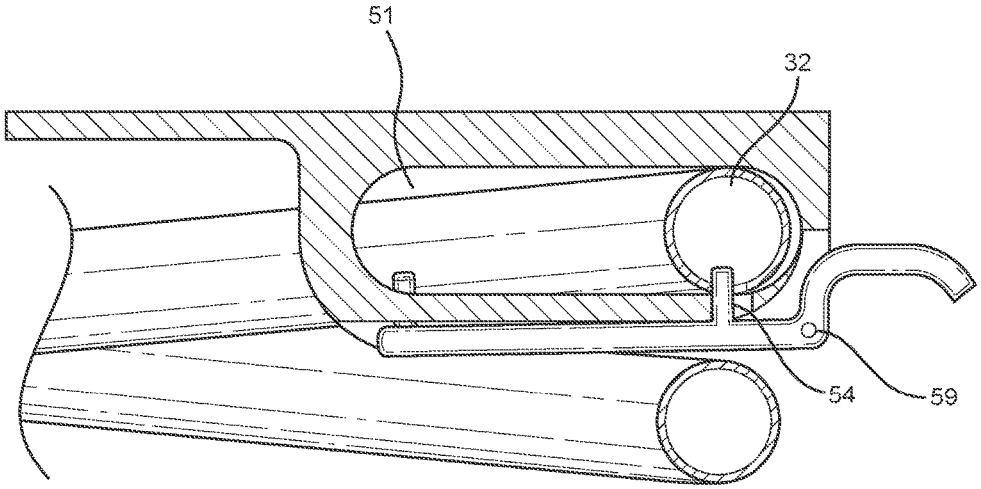
FIG. 5A shows a cross sectional view of the locking bracket of an alternative embodiment of the bag with integral legs in a locked position with a leg in a stowed position.
Figure 5B:
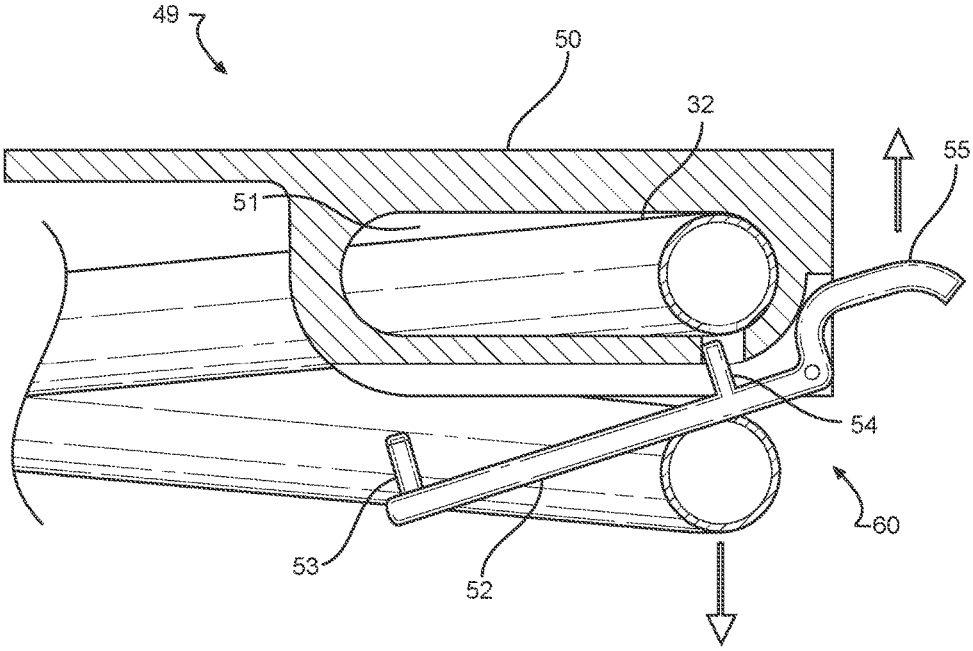
FIG. 5B shows a cross sectional view of the locking bracket in an open position with a leg in a stowed position.
Figure 6A:
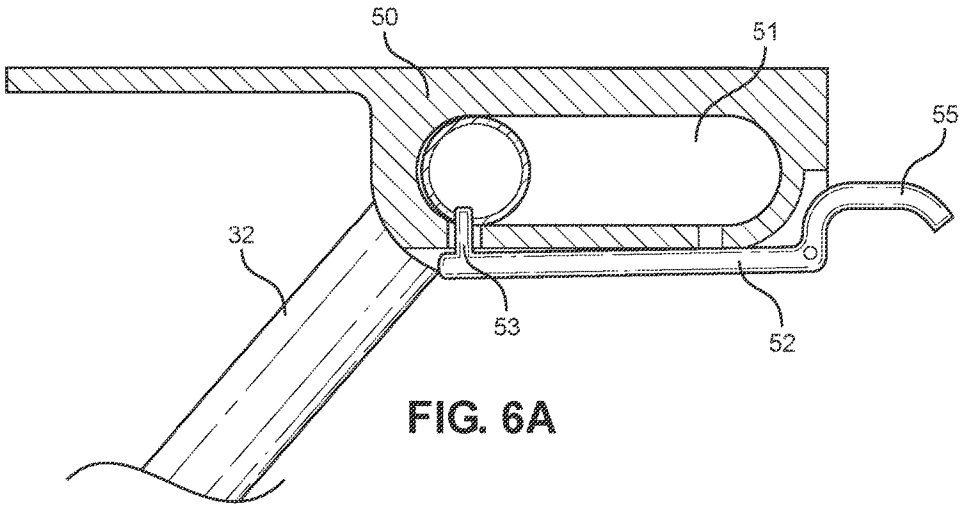
FIG. 6A shows a cross sectional view of the locking bracket in a locked position with a leg in an extended position.
Figure 6B:
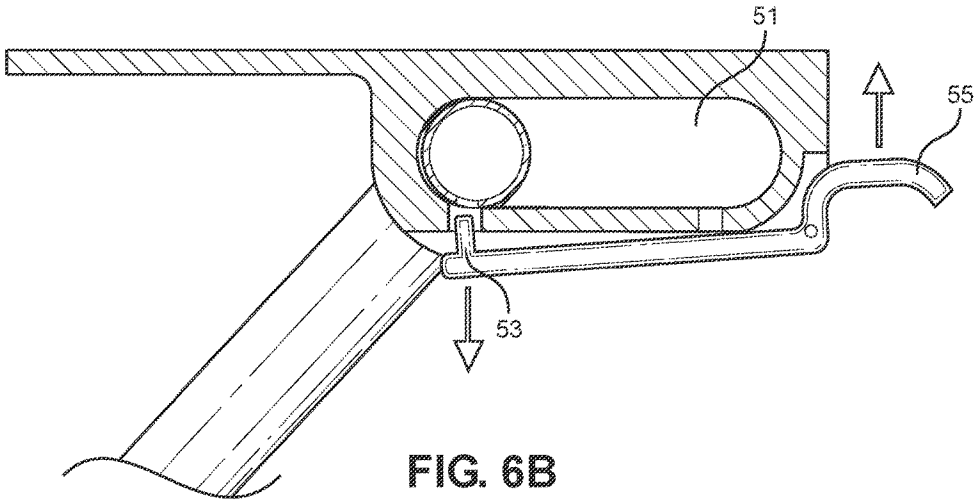
FIG. 6B shows a cross sectional view of the locking bracket in an open positioned with a leg in an extended position.

The locking hinge 49 includes a lever 60 pivotally secured to the bracket 50. The lever 60 comprises an elongated member 52 attached to a handle 55, wherein the elongated member 52 further comprises a first pin 54 at a first end and a second pin 53 at a second end. The lever 60 is biased toward a locked position, as shown in FIGS. 5A and 6A, wherein the first pin 54 is inserted within the top end of one of the pair of legs 32. The pin 54 is configured to prevent one of the pair of legs 32 from moving within the slot 51, thus locking it in place. When the handle 55 is pivoted away from the locked position, the first pin 54 is released from the leg 32, and the leg 32 may freely slide along the slot 51 into an extended position, as shown in FIG. 5B.

Once the leg 32 is in the extended position, the second pin 53 of the elongated member 52 is configured to be inserted within the top end of the leg 32, locking it in position and preventing it from sliding within the slot 51, as shown in FIG. 6A. Similar to when the leg 32 is in a stowed position, when the handle 55 is pivoted away from the locked position, the pin 53 is released from the leg 32 and the leg 32 may freely slide along the slot 51 back to a stowed position.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bag with integral legs, comprising:

a bag having a base and sidewalls forming a main compartment with an interior volume;

an opening adapted to provide access to the main compartment, wherein the opening is securably closable via a fastener;

a pair of legs pivotally secured to opposing ends of a lower side of the base, wherein the legs are configured to pivot between a stowed position and an extended position;

a pair of locking hinges configured to lock each of the pair of legs in the extended position;

wherein each locking hinge comprises a bracket having a slot therein, the slot configured to receive a top end of one of the pair of legs therein;

wherein the top end moves from a first end of the slot to a second end of the slot when the pair of legs are moved from the stowed position to the extended position;

wherein the legs in the extended position are configured to support the bag off of a ground surface;

a tray secured to the bag, wherein the tray is configured to extend outwardly from the bag and remain in a stable position.

2. The bag with integral legs of claim 1, further comprising a lower pocket disposed on the base, wherein the lower pocket is configured to fully enclose the pair of legs therein when the pair of legs is in the stowed position.

3. The bag with integral legs of claim 2, wherein the lower pocket further includes a cover that is securably closable via a fastener.

4. The bag with integral legs of claim 1, wherein the pair of legs is adjustable in height.

5. The bag with integral legs of claim 4, wherein the pair of legs further comprise multiple telescopic sections.

6. The bag with integral legs of claim 1, further comprises a carrying handle secured to the sidewalls.

7. The bag with integral legs of claim 1, further comprising secondary compartments.

8. The bag with integral legs of claim 1, wherein the tray is configured to lay in a horizontal position relative to a ground surface when in an extended position.

9. The bag with integral legs of claim 8, wherein the tray comprises a front panel of a secondary compartment of the bag.

10. The bag with integral legs of claim 9, wherein the tray is pivotally affixed to a sidewall of the bag, wherein the tray is configured to selectively move between a raised position and a lowered position, wherein the tray rests parallel to the base when in the lowered position and perpendicular to the base in the raised position.

11. The bag with integral legs of claim 10, wherein the tray further comprises a fastener disposed about a perimeter of the tray, wherein the fastener is configured to engage with a complementary fastener disposed about a border of the secondary compartment, thereby defining a secondary interior volume therein.

12. The bag with integral legs of claim 8, wherein bag further comprises a second slot disposed parallel to the base, wherein the tray is configured to be slideably removably from within the second slot.

13. The bag with integral legs of claim 12, wherein the second slot is disposed between a lower pocket and the main compartment.

14. The bag with integral legs of claim 1, further comprising a lever pivotally secured to the locking hinge, wherein the lever further comprises a first pin at a proximal end thereof, and a second pin at a distal end thereof.

15. The bag with integral legs of claim 14, wherein the slot further comprises a first aperture on the first end of the slot and a second aperture on the second end of the slot, wherein each of the first aperture and the second aperture are configured to receive the first pin and the second pin therethrough, respectively.

16. The bag with integral legs of claim 15, wherein the first pin is configured to engage the top end when in the stowed position and the second pin is configured to engage the top end when in the extended position.

17. The bag with integral legs of claim 14, wherein the lever is spring biased such that the first pin is engaged with the first aperture and the second pin is engaged with the second aperture when the lever is not actuated.

* * * * *